US005320545A

United States Patent [19]

Brothers

[11] Patent Number: 5,320,545

[45] Date of Patent: Jun. 14, 1994

[54] HOUSEHOLD SAFETY RECEPTACLE

[76] Inventor: Harlan J. Brothers, 17 Sybil Ave., Branford, Conn. 06045

[21] Appl. No.: 901,409

[22] Filed: Jun. 19, 1992

[51] Int. Cl.[5] ..... H01R 29/00

[52] U.S. Cl. ..... 439/188; 200/51.09; 439/140

[58] Field of Search ..... 200/51.09, 51.10; 439/137-139, 143, 107, 188

[56] References Cited

U.S. PATENT DOCUMENTS

| | | | |
|---|---|---|---|
| 2,184,359 | 12/1939 | Mueller | 200/51.09 |
| 2,826,652 | 3/1958 | Piplack | 200/51.09 |
| 3,596,019 | 7/1971 | Koester | 200/51.09 |
| 4,179,175 | 12/1979 | Farnworth et al. | 439/140 |
| 4,271,337 | 6/1981 | Barkas | 200/51.09 |

*Primary Examiner*—Paula A. Bradley
*Attorney, Agent, or Firm*—Robert L. Tucker

[57] ABSTRACT

A safety receptacle includes an insulating housing including a socket assembly having a first contact means and a second contact means therein adapted to receive the prongs of an electric plug, and first and second terminal means wherein the second terminal means is electrically active. A means for completing an electrical circuit through the prongs of the electric plug only when the prongs are in contact with the contact means includes means for electrically connecting the second contact means to the second terminal means only when one prong of the electric plug is received in the first contact means.

13 Claims, 4 Drawing Sheets

HOUSEHOLD SAFETY RECEPTACLE

BACKGROUND OF THE INVENTION

1. Field of the Invention

The present invention relates to a household receptacle or socket and more particularly to a household safety socket which will not conduct electricity until predetermined operations have been performed, thereby reducing the possibility of injury to children and the like.

2. Description of the Prior Art

According to National Electrical Code specifications, all currently manufactured household plug receptacles must be polarized. This means they have one large slot which is always grounded and one small "hot" slot from which the electrical current can be said to originate. These conventional electrical receptacles are dangerous to small children who may incur serious electrical shock and injury from sticking a screw driver, hair pin or finger into the hot slot. If the child sticks the same objects into the grounded slot, the child will suffer no ill effect. Conventional receptacles are also dangerous due to improper or loose insertion of an electrical plug in a standard receptacle which will cause a dangerous arcing of electrical current from the plug blades to the receptacle resulting in a burned receptacle face plate or a fire and possible injury to the user.

There are various known electrical safety constructions which employ various features such as switching means within the socket which must be actuated by the insertion of prong-like objects into the sockets to close the switching means before an electrical circuit will be completed. However, in most instances, the insertion of foreign objects such as screw drivers, finger nail files, or the like, would be effective to close the switching means and pose the possibility of considerable electrical harm, particularly to children.

A general definition of a safety receptacle is that it is made to prevent an unintended or accidental contact of the human body, e.g., the hand of a playing child, with any live parts of the socket. Substantially all types of receptacles or sockets include a lid or cover housing that conceals the live or potentially live parts which are accessible to the pins of a plug through openings in the front plate which is part of the cover housing or of the lid; while the openings have widths of generally less than five millimeters and are too small to permit penetration by a child's finger, there is always the danger that the child may hold a small metal piece, e.g. a nail or needle and try to explore socket in this manner. Further, when a plug is pulled from a socket by a child or a careless adult there is some danger that the hand which holds the plug while pulling will accidentally touch a part of a contact pin while the latter is still in contact with the live connector end of the receptacle socket.

SUMMARY OF THE INVENTION

Accordingly, it is an object of the present invention to provide a safety electrical socket that is safe for children and adults alike.

Another object is to provide such a safety socket that takes into account the critical and salient aspects of modern home electrical wiring and socket design to provide an inexpensive and highly efficient safety socket.

A further object is to provide such a safety socket that requires all of the prongs of an electrical plug to be inserted into the socket before the switching means can be closed to complete the circuit.

It is also an object to provide such a safety socket that is effective and inexpensive to manufacture.

It is another object to provide such a safety socket whereby it is impossible for any manipulation of a single object to electrify the user.

It is yet another object to provide such a safety socket that protects against potentially dangerous and incendiary arcing.

It is another object to provide such a safety device that is more convenient than covered sockets or sockets that slide or rotate which are inconvenient to use particularly when located behind tables, chairs or couches.

It is a further object to provide such a safety socket that has a minimal number of parts and is fully compatible with present standards and manufacturing techniques.

It has been found that the above and other objects of the present invention are attained in a household safety receptacle comprising an insulating housing including a socket assembly having a first contact means and a second contact means therein adapted to receive the prongs of an electric plug, and first and second terminal means wherein the second terminal means is electrically active. The receptacle also includes a means for completing an electrical circuit only when the ground plug is fully inserted into the contact means. The means includes means for electrically connecting the second contact means to the second terminal means only when one prong of the electric plug is received in the first contact means.

In a preferred embodiment, the safety receptacle comprises an insulating housing including a socket assembly having a first contact means and a second contact means therein adapted to receive the prongs of an electric plug and a first and second terminal means wherein the second terminal means is electrically active. The receptacle further includes a means for completing an electrical circuit through the prongs of the electric plug only when the prongs are fully inserted into the contact means. The means includes means for electrically connecting the second contact means to a first electrical contact electrically insulated from the second terminal means when one prong of the electric plug is received in the first contact means, and means for electrically connecting the first electrical contact to the second terminal means when a prong of the electric plug is received in the second contact means.

Preferably, the means for electrically connecting the second contact means includes a first switch means to electrically connect the second contact means to the first electrical contact. The first switch means is activated by inserting one prong of the electric plug into contact with the first contact means.

The safety receptacle further includes a second switch means to electrically connect the first electrical contact to the second terminal means. The second switch means is activated by inserting a prong of the electric plug into contact with the second contact means. The first and second switch means are connected in series between the second contact means and the second terminal means.

Other features and advantages of the present invention will become apparent from the following description of the invention which refers to the accompanying drawings.

BRIEF DESCRIPTION OF THE DRAWING(S)

For the purpose of illustrating the invention, there is shown in the drawings an embodiment which is presently preferred; it being understood, however, that the invention is not limited to the precise arrangements and instrumentalities shown.

DETAILED DESCRIPTION OF THE PREFERRED EMBODIMENT

Figure 1:
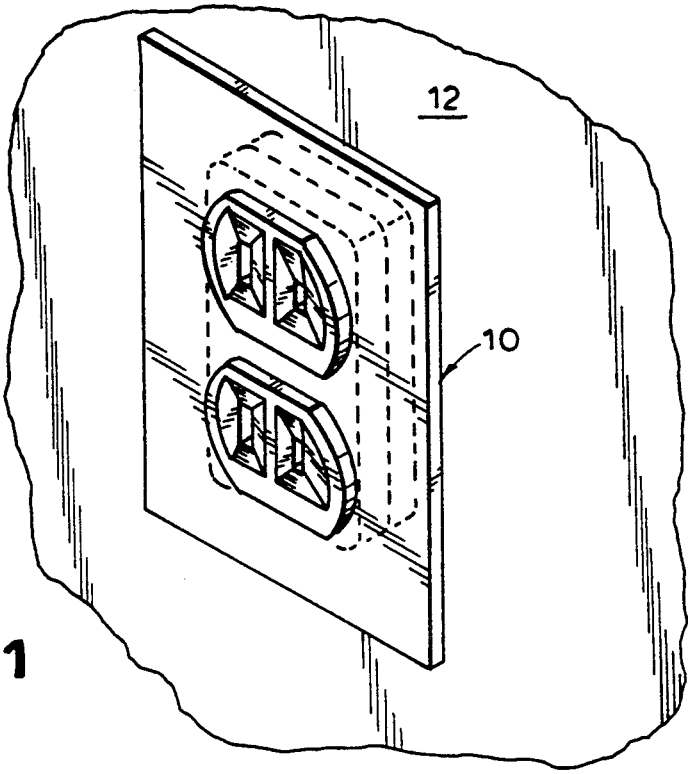
FIG. 1 is a perspective view of the safety socket of the present invention.

Referring now to the drawings wherein like numerals indicate like elements, there is shown in FIG. 1 the exterior of the safety socket of the present invention. The safety socket of the present invention is designed so that a child will not receive an electric shock if he sticks his fingers or other electrically conductive object in either of the slots; specifically the hot slot. A child who sticks his finger in the hot slot of a normal socket can receive a serious shock because he provides a ground path for the current. The present invention makes the situation extremely difficult because the hot slot is isolated from the electric source until a prong member is fully inserted into the other (ground) slot. An adult can receive a shock when inserting a plug into a normal socket if a finger accidental touches a prong as it first comes in contact with the metal contacts in the receptacle. Again, this device make the situation virtually impossible, for no current flows until the last moment of insertion.

The safety socket 10 generally relates to electric distribution and to convenience outlets having a contact system installed in an outlet of electricity for connection of at least one attachment plug having at least two contact pins and being of the general type used for a supply of electricity, e.g. at 110 or 220 volts, to portable equipment, such as lamps, appliances, electronic equipment, tools, machines, instruments, etc. at currents of typically up to 15 amperes. While the present invention is a safety socket designed for 120 or 220 volt household lines, the same concept can be applied to other types of receptacles.

Figure 2:
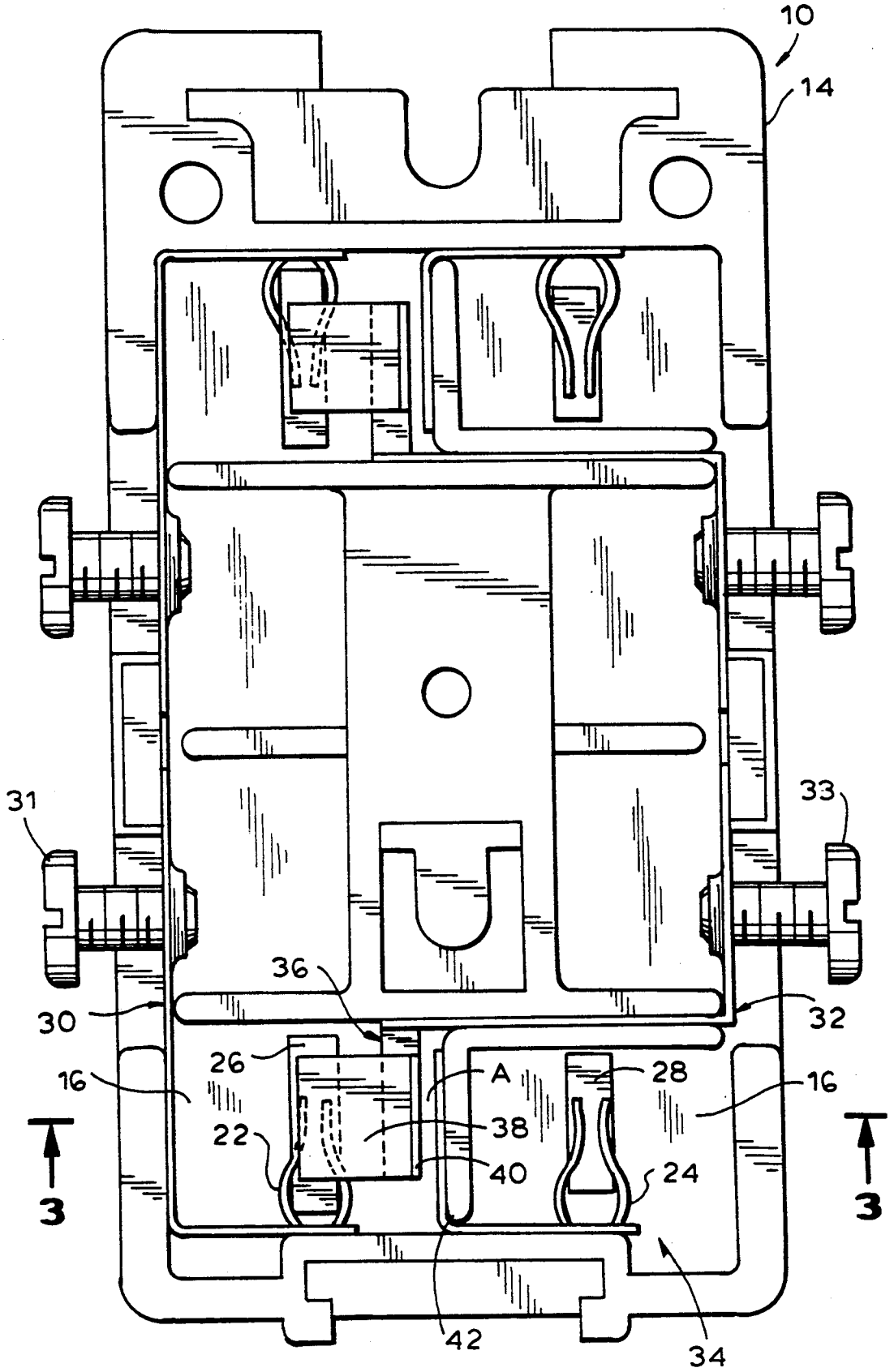
FIG. 2 is a bottom plan view of a longitudinal section of the safety socket of the present invention.
Figure 3:
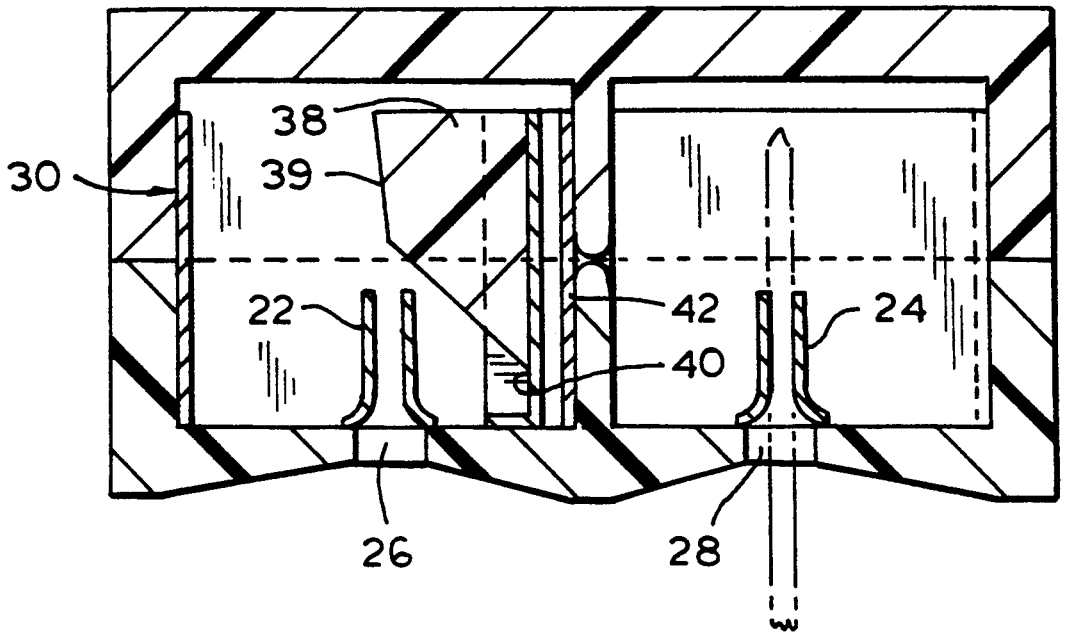
FIG. 3 is the safety socket of FIG. 2 taken along line 3—3 of FIG. 2.

There is shown in FIGS. 1-5 a complete operative embodiment of the invention. While the invention may be utilized in any of the various forms into which an electrical plug can be inserted, it will be described in terms of a conventional wall outlet containing a double socket. However, the details of only one socket will be described and like numerals will be applied where applicable. Referring now to FIGS. 1 and 2, there is shown a safety socket in accordance with the present invention, generally indicated as 10 mounted within a wall 12. The safety socket 10 includes a housing 14 formed of a non-conductive material such as plastic or ceramic, and is of dimensions in accordance with relevant electrical specifications, that is, having similar outward appearance and dimensions with conventional electric receptacles available on the market.

The housing 14 includes interior cavities 16. The cavities 16 house the various safety socket components of the present invention for receiving an electrical plug 18, shown in FIG. 4. For the purposes of this illustration, the plug is a standard household electrical plug having a pair of standard prong members 20.

Positioned in the housing in parallel relationship and having forward open ends, are conductive prong receiving contacts 22 and 24 and corresponding large and small prong slots 26, 28 into which prongs 20 of the electrical plug 18 may be inserted. Electrically conductive terminal members 30 and 32, including AC screw terminals 31, 33, are positioned in the housing in spaced relationship to corresponding prong receiving contacts 22 and 24. The terminal 30 represents the grounded terminal and is part of, and in constant electrical contact with, the prong receiving contact 22. The terminal 32 represents the electrically active or hot terminal and is separated from the prong receiving contact 24 by a small air gap A. An electric circuit within the socket cannot be completed until the prong receiving contact 24 is electrically connected to the terminal 32.

Figure 5:
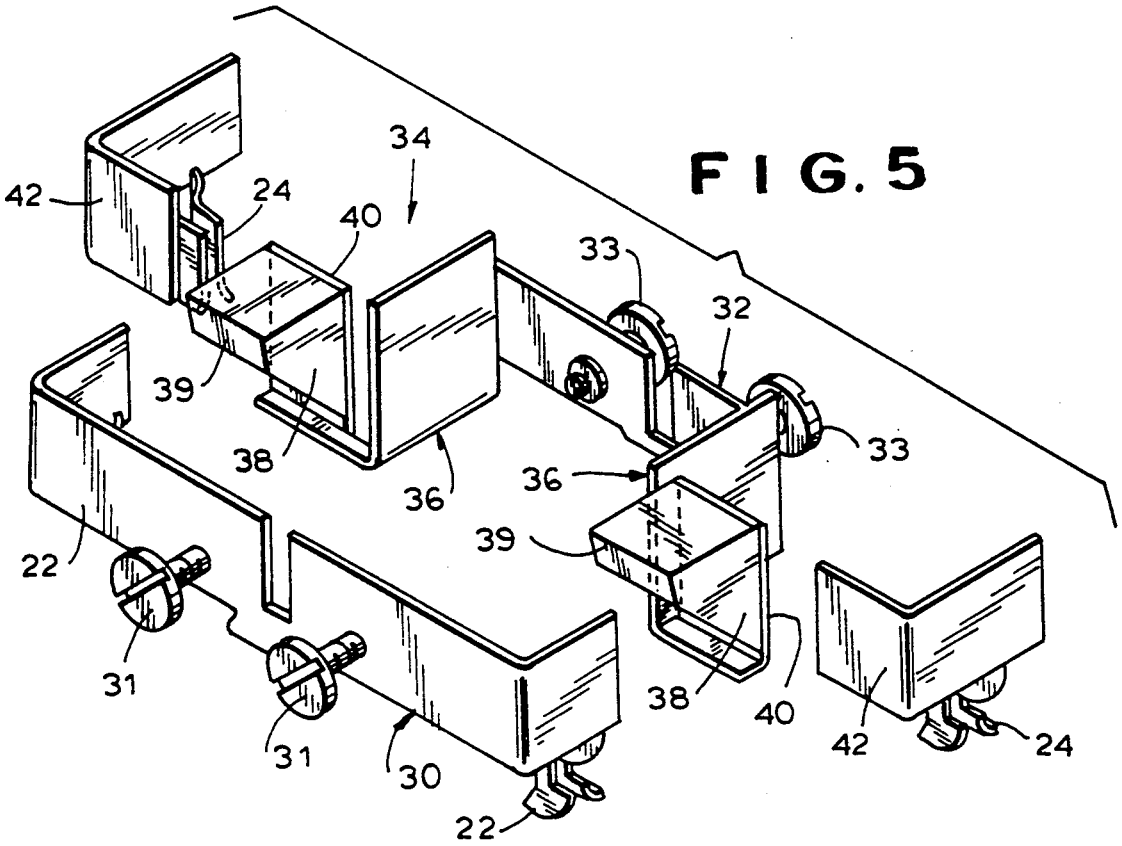
FIG. 5 is an exploded perspective view of the electrical contacts of the safety device of FIG. 2.

The energizing of the socket is controlled by the safety mechanism 34 shown in exploded view in FIG. 5. The terminal 32 includes an electrically conductive movable contact member 36. Mounted to the distal end of the movable contact member 36 is a cam member 38. The cam member 38 is triangularly shaped (FIGS. 3, 4) with a blunt end 39 and is formed of any durable non-conductive material such as plastics or ceramics. The cam member is so shaped to accommodate the full range of UL approved prong lengths. On an opposite face to the portion of the movable contact member 36 to which the cam 38 is mounted, is an electrically conductive contact portion 40. The contact 40 is spaced from the contact portion 42 (by the air gap A), which is part of, and in constant electrical contact with, the prong receiving contact 24.

Figure 4:
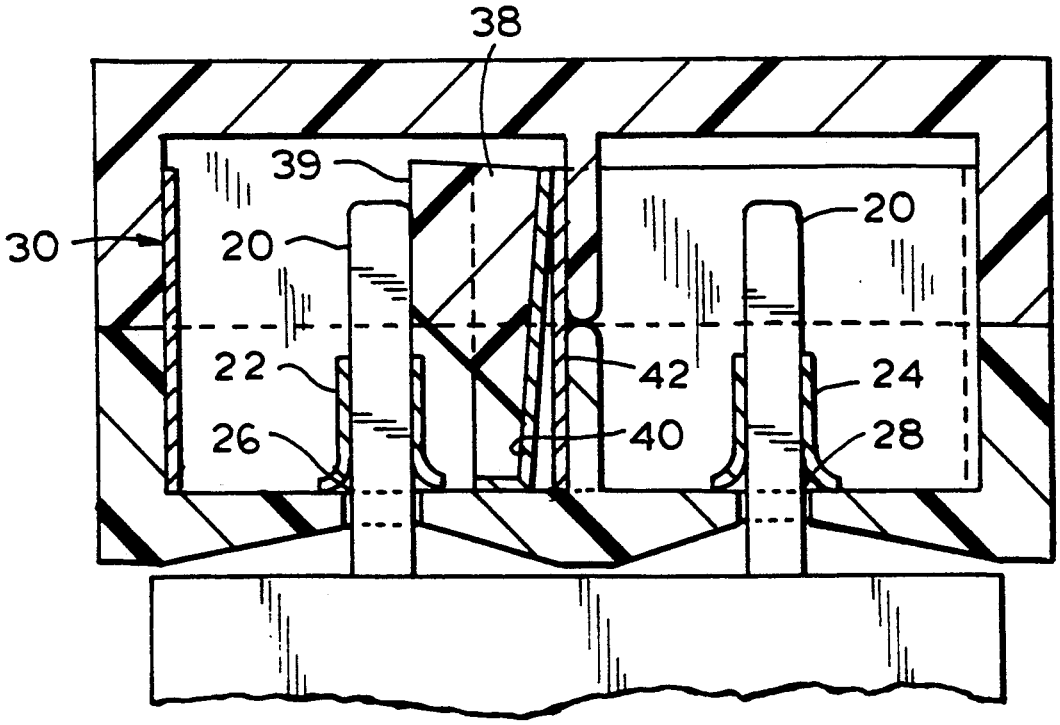
FIG. 4 is the safety socket of FIG. 3 showing the insertion of a plug therein.

The normally unenergized socket can be easily energized with an electrical plug as shown in FIG. 4. When the socket is normally in an unenergized or safe position, air gap A separates the contacts 40 and 42. Once a prong 20 of the plug 18 is inserted through the large slot 26 and the prong receiving contact 22, this causes the cam member 38 to move the contact 40 into electrical contact with contact 42. Simultaneously with the insertion of a prong 20 into the large slot 26 and into engagement with the prong 22, the other prong 20 is inserted through the small slot 28 and into contact with the prong receiving contact 24. As a result, an electrical circuit is created from the AC screw terminal 33 (hot), the contact 40, and the contact 42, through to the prong receiving contact 24. The prong receiving contact 22 is directly connected to the AC screw terminal 31 (ground). The cam member 38 mounted on the movable contact member 36 is biased so that when the prong 20 is removed from the slot 26, it springs back so that the contact 40 is again spaced from contact 42 by the air gap A.

With the socket thus assembled, it is extremely difficult for a small child to energize the socket and receive a shock. Even though a child may insert a wire, nail or similar object into either slot 26 or 28, the socket will not become activated unless such an object is fully inserted through the slot 26. Even so, if a metal object is inserted through slot 26, brought into electrical contact with prong receiving contact 22, and pushed into cam 38, this only serves to displace the cam 38 so that the contact 40 is in contact with contact 42. This action, however, will not result in any electrical shock because prong receiving contact 22 itself is grounded and the cam 38 insulates the metal object from contact 40 and hot terminal 32. If on the other hand, a metal object is inserted through slot 28 engaging prong receiving contact 24, (FIG. 3) the socket is also not energized because the prong receiving contact 24 electrically connected to contact 42 is not in electrical contact with contact 40 and hot terminal 32.

A possible, though unlikely occurrence which can arise from use of the embodiment of FIGS. 1-5 is described as follows: when an object is inserted through slot 26 to close the gap A between the contacts 40 and 42 by the camming action of the cam 38, this activates the hot side or prong receiving contact 24 of the safety socket 10. As a result, if a child sticks a slender object into the ground slot (through the slot 26) to activate the active side of the safety socket, and simultaneously touches the prong receiving contact 24 on the active side of the safety switch, electric shock can result.

Figure 6:
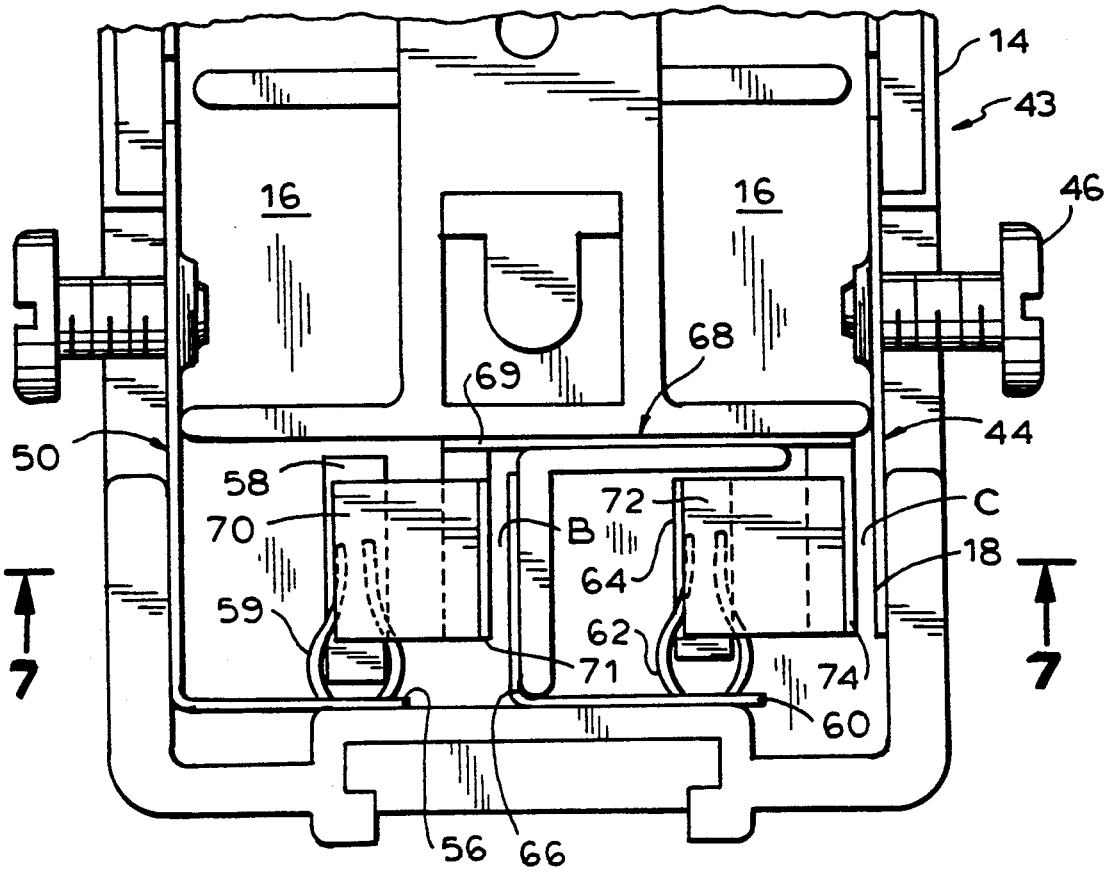
FIG. 6 is an alternative embodiment of the safety socket of FIG. 2.
Figure 7:
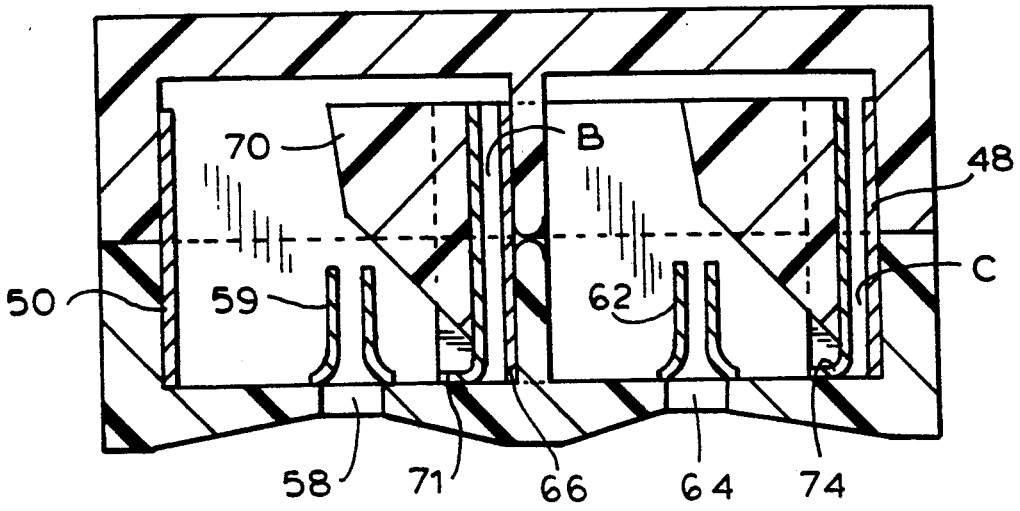
FIG. 7 is the safety socket of FIG. 6 taken along line 7—7 of FIG. 6.

Although the manual dexterity required to do this is too advanced for most children, this situation is overcome by an alternative embodiment 43 of the present invention as set forth in FIGS. 6 and 7. This embodiment is designed so that only when both prongs of a plug are fully inserted will any current flow. As a result, two members (at least one of which is conductive and inserted into the hot side) are required to be fully inserted into both slots of the socket to activate the hot side of the safety socket and to thereby allow any possibility of receiving a shock.

The alternative embodiment of the safety socket includes a housing 14 and the interior cavities 16 formed therein. Like the previous embodiment of the present invention, the cavities 16 house the various safety socket components for receiving the electrical plug 18 of FIG. 4. The safety socket components of the alternative embodiment of the present invention includes an electrically conductive hot terminal member 44 including an AC screw terminal 46 and a contact 48. On the opposite side of the housing 14 is an electrically conductive ground terminal member 50 including an AC ground screw terminal 52. Also included as part of the terminal member 50 and attached to a distal portion of the terminal member 50 is a prong contact member 56 which includes a prong receiving contact 59 aligned with a large slot 58 through which a prong 20 of the plug 18 will pass to come in contact with the prong receiving contact 59. On the opposite side or the hot side of the safety socket 43 is a prong contact member 60 which includes a prong receiving contact 62 aligned with a small slot 64 through which the other prong 20 of the plug 18 will pass to come in contact with the prong receiving contact 62. At the distal end of the prong contact member 60 from the prong receiving contact 62 is a contact 66.

Located between the prong receiving contacts 59 and 62 is a movable contact member 68. The movable contact member 68 includes an electrically conductive portion 69 and insulating cam members 70 and 72 mounted on opposite ends of the electrically conductive portion 69. The cam member 70 is aligned with the slot 58 and the prong receiving contact 59 and the cam member 72 is aligned with the slot 64 and the prong receiving contact 62. On the opposite side or face of the part of the electrically conductive portion 69 to which the cam member 70 is mounted is a contact 71 spaced from the contact 66 by an air gap B. Similarly, on the opposite side or face of the part of the electrically conductive portion 69 to which the cam member 72 is mounted is a contact 74 spaced from contact 48 by an air gap C. The cam members 70 and 72 of the movable contact member 68 are biased so that the contacts 71 and 74 of the cam members 70 and 72 are capable of contacting contacts 66 and 48, respectively, by camming action of the cam members 70, 72 when prong members 20 enter the slots 58, 64 and pass through the prong receiving contacts 59 and 62.

With the various parts of the alternative embodiment of the safety socket design described, its motive and operation is as follows. When the socket is in the normal unenergized or safe position, air gap B separates contacts 71 and 66 and air gap C separates contacts 74 and 48. When a prong 20 of the plug 18 travels through the large slot 58 and through prong receiving contact 59 it presses against cam member 70. This bridges the air gap B between contacts 71 and 66 providing electrical connection between the prong receiving contact 62 and the contact 74. Simultaneously, the second prong member 20 enters the small slot 64, through the prong receiving contact 62 and presses against the cam member 72. This bridges the air gap C between contacts 74 and 48 thus completing the electrical connection of the AC screw terminal 46 and the prong receiving contact 62. The prong receiving contact 59 is directly connected to the AC grounded screw terminal 52. The camming action of the cam members 70 and 72 in effect forms a pair of switches which are closed by the camming action of the cam members 70, 72 when the prongs 20 come into contact with the cam members. These two switches are connected in series between the prong receiving contact 62 and the AC screw terminal 46. Thus, when each prong 20 reaches the end of its travel into the socket, it presses against an insulating cam member, closing one of the two contacts necessary to provide current to the live prong receiving contact 62.

For non-polarized outlets (i.e. European systems), the cam members and associated contacts can be arranged in a cross-connected configuration that still maintains isolation from voltage.

In review, the above identified safety socket is designed so that only when both prongs of a plug are fully inserted will any current flow. A child who sticks his finger into the hot slot of a normal socket can receive a serious shock because he provides a ground path for the current. With the present invention, this situation is impossible because it is the full insertion of both prongs that provide the current to the current carrying prong receiving contact.

While there have been many attempts to make the common household socket safe for children and adults alike, the unique design of the present invention has the virtue of being both effective and inexpensive to manufacture. Also it is outwardly indistinguishable from a common electrical socket. It employs no rotating, sliding or pivoting parts, and no electronic components, all of which increase the likelihood of failure. Further, the design of the present invention takes into account the critical and salient aspects of modern home electrical wiring and socket design to provide an inexpensive and highly efficient safety socket. It can also be manufactured as a separate device to be plugged into any standard wall or electrical outlet requiring, for example, a substitute center screw.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A safety receptacle comprising:

an insulating housing including a socket assembly having a first contact means and a second contact means therein adapted to receive the prongs of an electric plug;

first and second terminal means wherein the second terminal means is electrically active; and means for electrically connecting the second contact means to the second terminal means after one prong of the electric plug is received in the first contact means.

2. The safety receptacle of claim 1, wherein the means for electrically connecting the second contact means includes a moveable contact member electrically connected to the second terminal means.

3. The safety receptacle of claim 2, wherein the movable contact member includes a contact adapted to move into electrical contact with the second contact means when one prong of the electric plug is received in the first contact means.

4. The safety receptacle of claim 3, wherein the contact is adapted to move out of electrical contact with the second contact means when the one prong of the electric plug is removed from the first contact means.

5. The safety receptacle of claim 3, wherein the contact is functionally affixed to a cam member to move the contact into electrical contact with the second contact means.

6. The safety receptacle of claim 5, wherein the cam member moves the contact out of electrical contact with the second contact means when the one prong of the electric plug is removed from the first contact means.

7. The safety receptacle of claim 5, wherein the cam member is made of insulating material.

8. A safety receptacle comprising:

an insulating housing including a socket assembly having a first contact means and a second contact means therein adapted to receive the prongs of an electric plug;

first and second terminal means wherein the second terminal means is electrically active; and means for completing an electrical circuit through the prongs of the electric plug after the prongs are in contact with the contact means, the means including a first electrical contact electrically insulated from the second terminal means, a first switch means for electrically connecting the second contact means to the first electrical contact, and a second switch means for electrically connecting the first electrical contact to the second terminal means.

9. The safety receptacle of claim 8, wherein the means for completing an electrical circuit includes means for completing an electrical circuit through the prong of the electric plug only when the prongs are in contact with the contact means, the means including means for electrically connecting the second contact means to a first electrical contact electrically insulated from the second terminal means when one prong of the electric plug is received in the first contact means, and means for electrically connecting the first electrical contact to the second terminal means when a prong of the electric plug is received in the second contact means.

10. The safety receptacle of claim 8, wherein the first switch means is activated by placing one prong of the electric plug into contact with the first contact means.

11. The safety receptacle of claim 8, wherein the second switch means is activated by placing one prong of the electric plug into contact with the second contact means.

12. The safety receptacle of claim 8, wherein the first and second switch means are connected in series between the second contact means and the second terminal means.

13. A safety receptacle comprising:

an insulating housing including a socket assembly having a first contact means and a second contact means therein adapted to receive the prongs of an electric plug;

first and second terminal means wherein said means are electrically active;

means for electrically connecting the second contact means to the second terminal means after one prong of the electric plug is received in the first contact means; and means for electrically connecting the first contact means to the first terminal means only after prong of the electric plug is received in the second contact means.

* * * * *